US008616170B2

(12) United States Patent
Horikoshi et al.

(10) Patent No.: US 8,616,170 B2
(45) **Date of Patent: *Dec. 31, 2013**

(54) RECOIL STARTER

(75) Inventors: Yoshinori Horikoshi, Tokyo (JP); Seiichi Nieda, Tokyo (JP); Taro Kihara, Tokyo (JP); Hirotoshi Fujita, Tokyo (JP)

(73) Assignee: Starting Industrial Co., Ltd., Tokyo (JP)

( * ) Notice: Subject to any disclaimer, the term of this patent is extended or adjusted under 35 U.S.C. 154(b) by 627 days.

This patent is subject to a terminal disclaimer.

(21) Appl. No.: 12/868,006

(22) Filed: Aug. 25, 2010

(65) Prior Publication Data

US 2011/0048361 A1 Mar. 3, 2011

(30) Foreign Application Priority Data

Aug. 29, 2009 (JP) ..... P2009-199099
Nov. 6, 2009 (JP) ..... P2009-254626

(51) Int. Cl.
*F02N 5/02* (2006.01)
*F02N 5/00* (2006.01)

(52) U.S. Cl.
USPC ..... 123/185.3

(58) Field of Classification Search
USPC ..... 123/185.3, 185.2, 185.14; 185/39, 41 A, 185/41 C, 41 R
See application file for complete search history.

(56) References Cited

U.S. PATENT DOCUMENTS

| | | | | |
|---|---|---|---|---|
| 4,167,929 | A * | 9/1979 | DuBois | 123/185.1 |
| 4,582,030 | A * | 4/1986 | Reese | 123/185.3 |
| 5,083,534 | A | 1/1992 | Morishima et al. | |
| 6,508,220 | B1 | 1/2003 | Akaike et al. | |
| 7,069,896 | B2 * | 7/2006 | Tsunoda et al. | 123/185.3 |
| 7,650,868 | B2 * | 1/2010 | Fujita et al. | 123/185.14 |
| 8,286,604 | B2 * | 10/2012 | Kihara et al. | 123/185.14 |
| 2004/0168668 | A1 | 9/2004 | Tsunoda et al. | |
| 2008/0173272 | A1 * | 7/2008 | Fujita et al. | 123/185.3 |

FOREIGN PATENT DOCUMENTS

| | | |
|---|---|---|
| EP | 1 900 936 | 3/2008 |
| EP | 1 965 073 | 9/2008 |
| JP | 2001-65435 | 3/2001 |
| JP | 2002-227753 | 8/2002 |
| JP | 2004-285875 | 10/2004 |
| JP | 2006-329179 | 12/2006 |
| JP | 2006-342717 | 12/2006 |

OTHER PUBLICATIONS

Extended European Search Report dated Mar. 15, 2012 issued in European Patent Application No. 10174166.8, 7 pp.
Japanese Office Action dated Sep. 3, 2013 issued in Japanese Patent Application No. 2009-254626 and English Translation, 4 pp.

* cited by examiner

*Primary Examiner* — Mahmoud Gimie
(74) *Attorney, Agent, or Firm* — Nixon & Vanderhye P.C.

(57) ABSTRACT

One of the embodiments provides a starter including: a starter case; a rotational torque applying unit; a torque-accumulation spring; a rotating member; a driving pulley; and a rotation regulating mechanism including: a regulating ratchet provided on the driving pulley or the rotating member at a position shifted from a rotation center thereof; and a pressing unit provided on the starter case and urged by a given resilient pressing force to be engaged with the regulating ratchet, wherein, when the rotational torque accumulated in the torque-accumulation spring exceeds the given resilient pressing force, the driving pulley or the rotating member urges back the pressing unit via the regulating ratchet so that the regulating ratchet is disengaged from the pressing unit, to thereby release the rotational torque.

11 Claims, 10 Drawing Sheets

RECOIL STARTER

CROSS-REFERENCE TO RELATED APPLICATION(S)

This application claims priorities from Japanese Patent Application No. 2009-199099 filed on Aug. 29, 2009, and from Japanese Patent Application No. 2009-254626 filed on Nov. 6, 2009, the entire contents of which are herein incorporated by reference.

FIELD

Embodiments described herein relate to a starter configured to sufficiently accumulate a rotational torque in a torque-accumulation spiral spring for starting an engine.

BACKGROUND

Generally, a starter for a small engine includes a pulley, a cam plate (drive cam), a torque-accumulation spiral spring and a drive gear. The pulley is fixed to a crank shaft of the engine. A centrifugal ratchet is provided on the pulley to be engaged with a cam pawl provided in the cam plate. The drive gear is connected to the cam plate through the torque-accumulation spiral spring.

The drive gear is rotated manually or mechanically (using a sel-motor, for example) to accumulate a rotational torque (energy) in the torque-accumulation spiral spring, thereby starting the engine. When the accumulated rotational torque exceeds a rotational resistance of the engine, the rotational torque accumulated in the torque-accumulation spiral spring is abruptly released to transmit the rotational torque to the crank shaft through the cam plate and the pulley, and the engine is started (for example, see JP-2002-227753-A)

However, the rotational resistance of the engine is not constant. For example, the rotational resistance of the engine becomes highest when a piston is located around an upper dead point, and becomes lowest when the piston is located around a lower dead point.

The rotational resistance of the engine is unstable and changed depending on circumstances. Therefore, when the rotational resistance is low, even before the starting rotational torque (rotational torque necessary for starting the engine) is accumulated in the torque-accumulation spiral spring, the accumulated energy may temporarily (transiently) exceed the rotational resistance to rotate the cam plate. When the cam plate is allowed to be rotated by an insufficiently accumulated energy, since the starting rotational torque cannot be transmitted to the pulley, the engine can not be surely started.

SUMMARY

One object of the present invention is to provide a starter configured to sufficiently accumulate a rotational torque in a torque-accumulation spiral spring for surely starting an engine irrespective of a variation in a rotational resistance of the engine.

According to a first aspect of the present invention, there is provided a starter including: a starter case; a rotational torque applying unit provided in the starter case and configured to generate a rotational torque; a torque-accumulation spring configured to accumulate the rotational torque applied from the rotation torque applying unit; a rotating member provided in the starter case and configured to receive the rotational torque from the torque-accumulation spring; a driving pulley connected to an engine and configured to be engaged/disengaged with the rotating member; and a rotation regulating mechanism including: a regulating ratchet provided on the driving pulley or the rotating member at a position shifted from a rotation center thereof; and a pressing unit provided on the starter case and urged by a given resilient pressing force to be engaged with the regulating ratchet, wherein, when the rotational torque accumulated in the torque-accumulation spring exceeds the given resilient pressing force, the driving pulley or the rotating member urges back the pressing unit via the regulating ratchet so that the regulating ratchet is disengaged from the pressing unit, to thereby release the rotational torque.

According to a second aspect of the present invention, there may be provided the starter, wherein the resilient pressing force provided to the pressing unit is set to be larger than a starting rotational torque necessary to start the engine.

According to a third aspect of the present invention, there may be provided the starter, wherein the regulating ratchet is provided on the driving pulley, wherein, when the driving pulley is rotated, the regulating ratchet is held in a position where the regulating ratchet is not engaged with the pressing unit due to a centrifugal force, and wherein, when the rotating member is stopped, the regulating ratchet is returned to a position where the regulating ratchet is engaged with the pressing unit.

According to a fourth aspect of the present invention, there may be provided the starter, wherein the regulating ratchet is provided on the rotating member, wherein, when the rotating member is rotated, the regulating ratchet is held in a position where the regulating ratchet is not engaged with the pressing unit due to a centrifugal force, and wherein, when the rotating member is stopped, the regulating ratchet is returned to a position where the regulating ratchet is engaged with the pressing unit.

According to a fifth aspect of the present invention, there may be provided the starter, wherein the rotating member and the driving pulley are connected through a clutch mechanism.

According to a sixth aspect of the present invention, there may be provided the starter, wherein the pressing unit includes: a regulating cam pivotably provided in the starter case and having an end to be engaged with the regulating ratchet; and a resilient unit configured to provide the resilient pressing force to the regulating cam.

According to a seventh aspect of the present invention, there may be provided the starter, wherein the pressing unit includes: a shaft slidably provided in the starter case and having an end to be engaged with the regulating ratchet; and a resilient unit configured to provide the resilient pressing force to the shaft.

According to an eighth aspect of the present invention, there may be provided the starter, wherein the pressing unit includes: a regulating cam pivotably provided in the starter case and having an end to be engaged with the regulating ratchet; a shaft provided engaged with the regulating cam; and a resilient unit configured to provide the resilient pressing force to the shaft.

According to a ninth aspect of the present invention, there may be provided the starter, wherein the resilient unit is a leaf spring or a coil spring.

According to a tenth aspect of the present invention, there may be provided the starter, wherein the torque-accumulation spring is a spiral spring or a coil spring.

According to the first aspect of the present invention, since the rotation regulating mechanism includes the regulating ratchet provided on the driving pulley or the rotating member at the position shifted from the rotation center thereof and the pressing unit engaged with the regulating ratchet from the starter case side to regulate the operation range of the regulating ratchet with the given resilient pressing force, and when the accumulated rotational torque exceeds the resilient pressing force, the regulating ratchet is disengaged from the pressing unit to release the accumulated rotational torque, the sufficient rotational torque (energy) can be accumulated in the torque-accumulation spring irrespective of the variation in the rotational resistance of the engine, and the engine can be surely started.

Since the regulating ratchet can be provided in a dead space not overlapping with the rotating shaft thereof, the starter can be made compact. When the regulating ratchet is provided on the driving pulley, since the regulating ratchet is attached to the engine-side driving pulley, a deflection of the rotation can be minimized and the rotation can be stabilized.

According to the third aspect of the present invention, since when the driving pulley is rotated, the regulating ratchet is held in a position where the regulating ratchet is not engaged with the pressing unit due to a centrifugal force, and when the rotating member is stopped, the regulating ratchet is returned to a position where the regulating ratchet is engaged with the pressing unit, the rotation regulating mechanism does not need to be externally operated.

According to the fourth aspect of the present invention, the same effect as that in the third aspect of the present invention can be obtained.

According to the fifth aspect of the present invention, since the rotating member and the driving pulley are connected through a clutch mechanism, the regulating ratchet may be provided either in the rotating member or the driving pulley. As the clutch mechanism, any mechanism may be used. A centrifugal clutch type or a friction clutch type may be used.

According to the sixth aspect of the present invention, since the pressing unit includes a regulating cam pivotably provided in the starter case and having an end to be engaged with the regulating ratchet and a resilient unit that applies the resilient pressing force to the regulating cam, the regulating ratchet and the regulating cam can be surely engaged with or disengaged from each other.

According to the seventh aspect of the present invention, since the pressing unit includes a shaft provided in the starter case so as to be slidable and having an end to be engaged with the regulating ratchet and a resilient unit that applies the resilient pressing force to the shaft, the shaft's movement and an engine starting timing can be made visually recognizable from exterior with a simple structure.

According to the eighth aspect of the present invention, since the pressing unit includes a regulating cam pivotably provided in the starter case and having an end to be engaged with the regulating ratchet, a shaft provided so as to be engaged with the regulating cam and a resilient unit that applies the resilient pressing force to the shaft, the shaft's movement and an engine starting timing can be made visually recognizable from exterior with a simple structure.

According to the ninth aspect of the present invention, since the resilient unit is a leaf spring or a coil spring, a cost of the resilient unit can be lowered.

According to the tenth aspect of the present invention, since a spiral spring or a coil spring is used as the torque-accumulation spring, a cost of the torque-accumulation spring can be lowered.

DETAILED DESCRIPTION

[First Embodiment]

Figure 1:
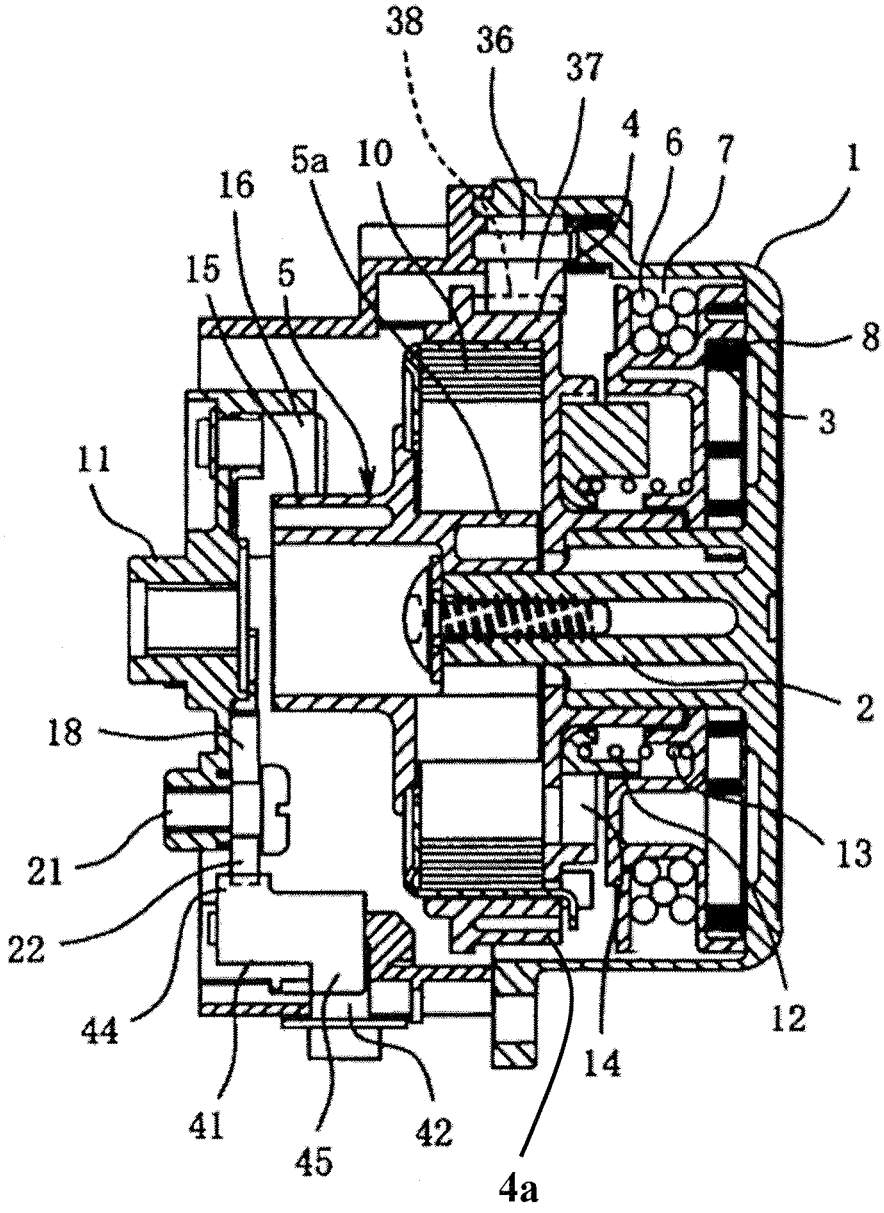
FIG. 1 is a longitudinally sectional view of an engine starter of a first embodiment.
Figure 2A:
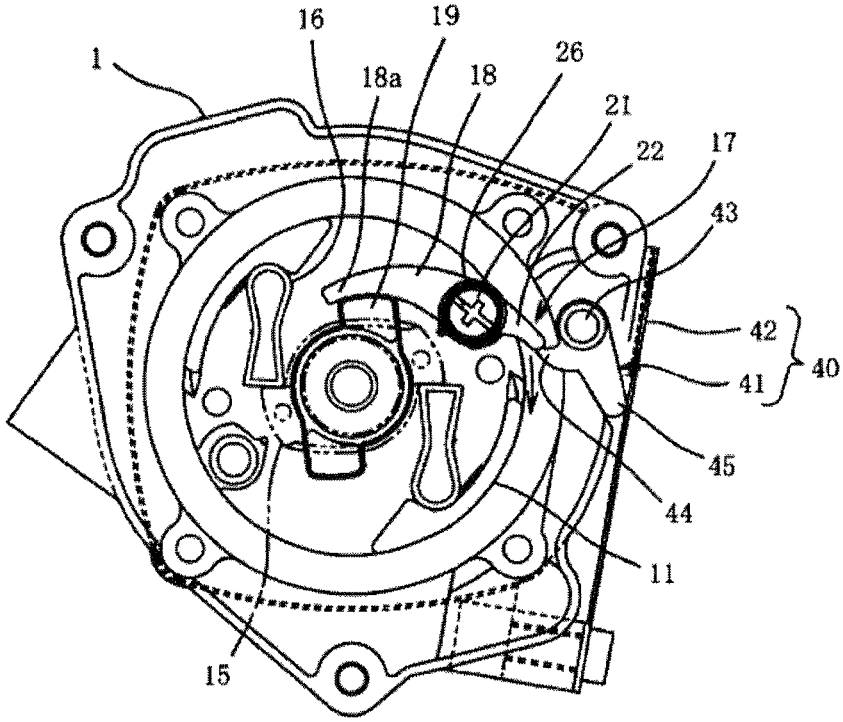
FIGS. 2A and 2B are side views showing an engaged state and a disengaged state of a regulating ratchet and a pressing unit of the engine starter.
Figure 2B:
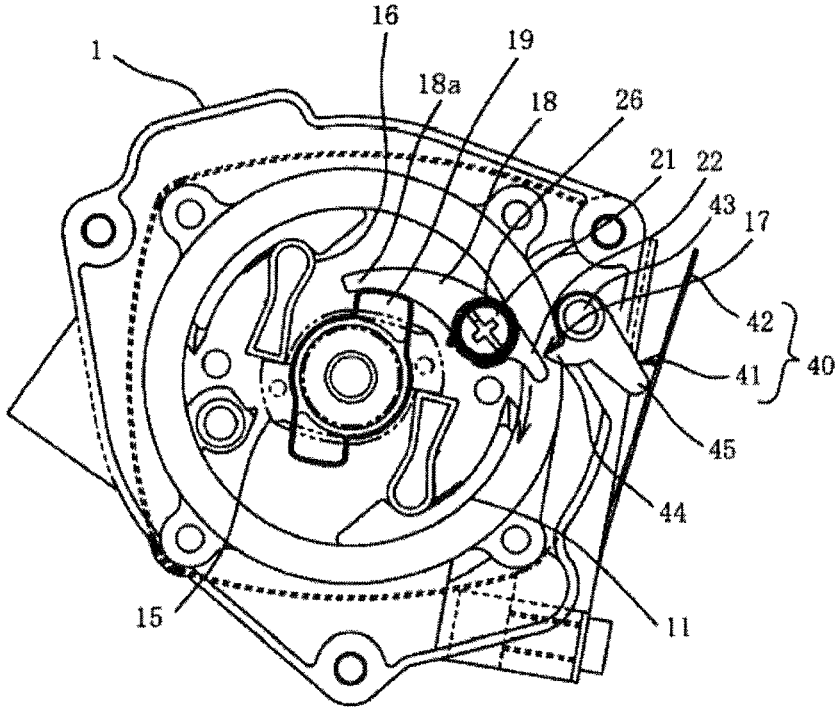

As shown in FIGS. 1 to 2B, a starter case 1 has a support shaft 2 protruded therefrom, and a rope reel 3, a barrel 4 and a cam plate 5 are rotatably arranged on the support shaft 2.

In the rope reel 3, an accommodating groove 7 for a starter rope 6 is formed on an outer peripheral surface thereof, and an accommodating part for a return spiral spring 8 is formed on an outer face thereof.

At an inner face side of the barrel 4, a torque-accumulation spiral spring 10 is accommodated. The barrel 4 has an engagement portion 4*a*, and the cam plate 5 has an engagement portion 5*a*. One end (radial-outer end) of the torque-accumulation spiral spring 10 is engaged with the engagement portion 4*a* of the barrel 4, and the other end (radial-inner end) thereof is engaged with the engagement portion 5*a* of the cam plate 5, as shown in FIG. 1.

A driving pulley 11 is fixed to an engine's crank shaft (not shown), and the cam plate 5 as a rotating member is engageable with the driving pulley 11 to transmit a rotational torque thereto.

Between the rope reel 3 and the barrel 4, a one-way clutch 12 is arranged. The one-way clutch 12 is engageable with the barrel 4, and is always engaged with the rope reel 3 to rotate together therewith. The barrel 4 has a pawl 14 on the side surface thereof. The one-way clutch 12 is urged by the spring 13 to be engaged with the pawl 14 of the barrel 4, when the one-way clutch 12 is rotated in one direction relative to the barrel 4. And, when the one-way clutch 12 is rotated in an opposite direction, the one-way clutch 12 is pushed out and disengaged from the pawl 14 against a force of the spring 13.

The cam plate 5 is disposed to close an opened end of the barrel 4. One end of the cam plate 5 is rotatably supported by the support shaft 2 and engaged with the above-described end of the torque-accumulation spiral spring 10. In the other end of the cam plate 5, a cam pawl 15 is formed.

The driving pulley 11 is connected to the output shaft of the engine concentrically with the cam plate 5. A centrifugal ratchet 16 is pivotably provided on a radial-outer side of the driving pulley 11. When the driving pulley 11 is rotated in one direction relative to the cam plate 5, the centrifugal ratchet 16 is engaged with the cam pawl 15 of the cam plate 5. And, when the driving pulley 11 is rotated in an opposite direction, the engagement is released.

Between the barrel 4 and the starter case 1, a one-way clutch (other than the above-described one-way clutch 12) is provided to allow the barrel 4 to rotate only in a direction for winding the torque-accumulation spiral spring 10. A shaft 36 is provided inside the starter case 1, and a clutch pawl 37 is pivotably provided on the shaft 36. The clutch pawl 37 is constantly urged so that an end thereof abuts on an outer peripheral surface of the barrel 4. Correspondingly, engaging parts 38 are formed on the outer peripheral surface of the barrel 4 at given interval. When the barrel 4 is rotated in the same direction as that of the rope reel 3, the clutch pawl 37 is not engaged with the engaging part 38. And, when the barrel 4 is rotated in an opposite direction to that of the rope reel 3, the clutch pawl 37 is engaged with the engaging part 38.

When the rope reel 3 is rotated by pulling the starter rope 6, its rotational torque is transmitted to the barrel 4 through the one-way clutch 12 to rotate the barrel 4, so that the torque-accumulation spiral spring 10 is wound-up to accumulate the rotational torque. When the accumulated rotational torque reaches a given level or higher, the cam plate 5 is rotated. When the cam plate 5 is rotated, the cam pawl 15 of the cam plate 5 is engaged with the centrifugal ratchet 16 provided on the driving pulley 11 to transmit the rotational torque to the driving pulley 11. Then, the driving pulley 11 is rotated to start the engine through the crankshaft connected to the driving pulley 11.

When the starter rope 6 is loosened after being pulled, the barrel 4 is urged to be reversely rotated by a resilient force of the torque-accumulation spiral spring 10. However, since the engaging part 38 on the outer periphery of the barrel 4 is engaged with the clutch pawl 37 in the starter case 1, the barrel 4 is prevented from reversely rotating. For example, the torque-accumulation spiral spring 10 is gradually wound-up by repeating (slightly) pulling/returning of the starter rope 6.

Thus, the rotational torque is accumulated in the torque-accumulation spiral spring 10 by a rotational torque applying unit configured by the rope reel 3 and the starter rope 6. When the accumulated rotational torque finally exceeds a rotational resistance of the engine, the cam plate 5 rotates the crank shaft through the driving pulley 11.

In a case where the rotational resistance of the engine is temporarily low, if the cam plate 5 is allowed to rotate before the sufficient rotational torque is accumulated in the torque-accumulation spiral spring 10, although the driving pulley 11 is rotated, the engine may not be started.

In the embodiment, a rotation regulating mechanism (torque limiter) 17 is provided in the starter. The rotation regulating mechanism 17 restrains the rotational torque accumulated in the torque-accumulation spiral spring 10 from being transmitted to an engine side until the accumulated rotational torque reaches the starting rotational torque (rotational torque necessary for starting the engine) irrespective of the variation in the rotational resistance of the engine.

The rotation regulating mechanism 17 includes a regulating ratchet 18 provided on the driving pulley 11 and a pressing unit 40 for regulating an operation range of the regulating ratchet 18 by a given resilient pressing force.

The regulating ratchet 18 is an arched member having a curved intermediate part. A support shaft 21 is provided on a driving pulley 11 at a position shifted from a rotation center thereof, and the regulating ratchet 18 is pivotably provided on the support shaft 21. One end part 18*a* of the regulating ratchet 18 is urged to be engaged with a protruding part 19 provided on a side surface of the driving pulley 11 by a torsion coil spring 26 wound on the support shaft 21. The other end of the regulating ratchet 18 functioning as an engaging pawl 22 protrudes outside the outer peripheral edge of the driving pulley 11.

The pressing unit 40 includes a regulating cam 41 and a leaf spring (resilient unit) 42.

The regulating cam 41 is pivotably provided on a rotating shaft 43 in the starter case 1. A pressing piece 44 is protruded from one end side of the rotating shaft 43, and an engaging piece 45 is protruded from the other end side. The pressing piece 44 and the engaging piece 45 are formed to be staggered as shown in FIG. 1. The pressing piece 44 is arranged so as to be engaged with the engaging pawl 22 of the regulating ratchet 18 protruding outside the outer peripheral edge of the driving pulley 11. The engaging piece 45 is engaged with the leaf spring 42 so as to be pushed inside the starter case 1 by a resilient pressing force of the leaf spring 42. That is, by the leaf spring 42 pushing the engaging piece 45 of the regulating cam 41, the pressing piece 44 is brought into engagement with the engaging pawl 22 protruding outside the outer peripheral edge of the driving pulley 11.

The leaf spring 42 applies the resilient pressing force against the rotation of the regulating cam 41 on the rotating shaft 43. The resilient pressing force by the spring load of the leaf spring 42 is set to a level the same as the starting rotational torque (rotational torque necessary for starting the engine) or higher.

An operation of the above-described rotation regulating mechanism will be described below. As shown in FIG. 2A, normally, the resilient pressing force of the leaf spring 42 is applied to the regulating cam 41, and the engaging pawl 22 of the regulating ratchet 18 is engaged with the pressing piece 44 of the regulating cam 41. Therefore, even when the starter rope 6 is pulled and the barrel 4 is rotated, the cam plate 5 cannot be rotated. When the accumulated rotational torque does not satisfy the spring load (resilient pressing force) of the leaf spring 42 exceeding the starting rotational torque, the cam plate 5 is not rotated. As the torque-accumulation spiral spring 10 is wound-up, the rotational torque is increased. And, when the accumulated rotational torque exceeds the resilient pressing force of the leaf spring 42, the cam plate 5 is rotated little by little. Accordingly, the pressing piece 44 of the regulating cam 41 is pushed by the engaging pawl 22 of the regulating ratchet 18 and moved backward. Finally, as shown in FIG. 2B, the engaging pawl 22 is disengaged from the pressing piece 44 so that the accumulated rotational torque is abruptly released. As a result, the rotational torque of the torque-accumulation spiral spring 10 is transmitted to the cam plate 5, and further transmitted to the driving pulley 11 through a clutch mechanism formed by the centrifugal ratchet 16 and the cam pawl 15 to thereby rotate the driving pulley 11 and start the engine.

Figure 3:
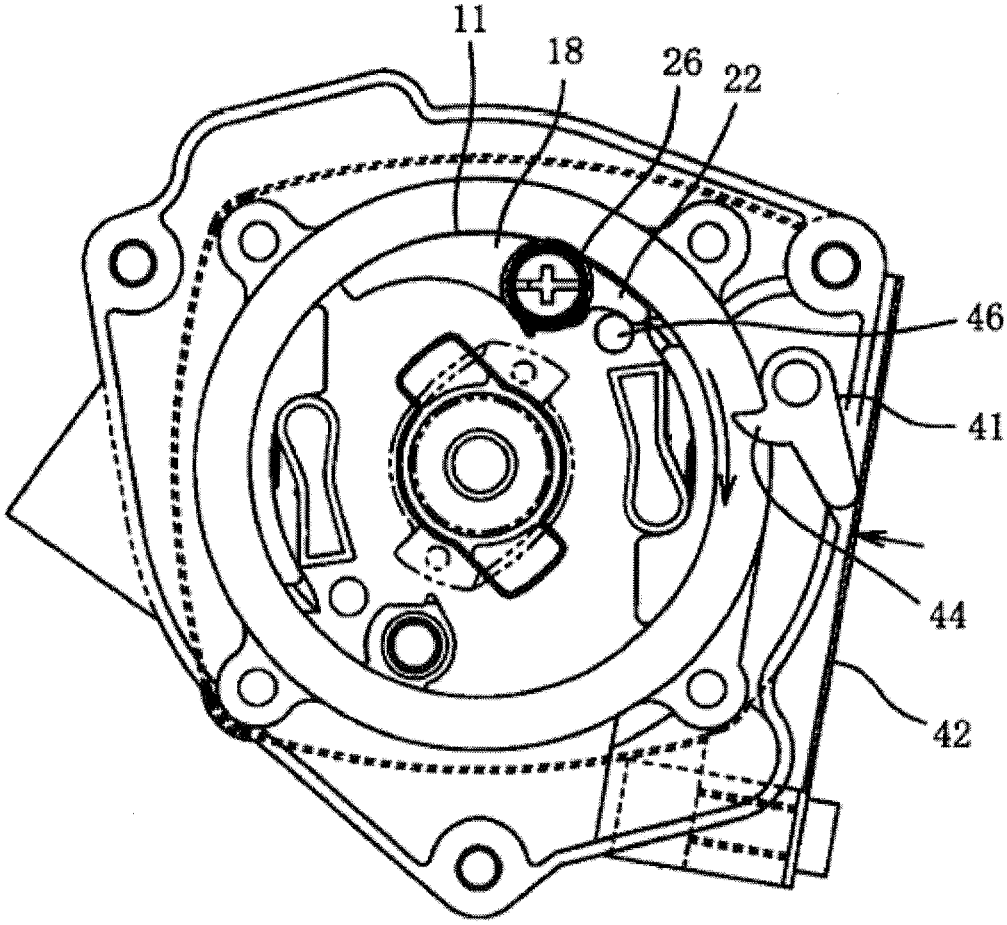
FIG. 3 is a side view showing a state that an engine is started by the engine starter.

When the engine is rotated, the regulating ratchet 18 is rotated against the resilient force of the torsion coil spring 26 due to a centrifugal force thereof. As shown in FIG. 3, the engaging pawl 22 is retracted within the outer periphery of the driving pulley 11 while abutting on a pin 46 provided on the driving pulley 11. Accordingly, the engaging pawl 22 is held at a position where the engaging pawl 22 is not engaged with the protruding pressing piece 44 of the regulating cam 41.

When the rotation of the engine is stopped, the regulating ratchet 18 is rotated by the resilient force of the torsion coil spring 26. The engaging pawl 22 protrudes beyond the outer periphery of the driving pulley 11 to return to a position where the engaging pawl 22 can be engaged with the pressing piece 44 of the regulating cam 41 in a stand-by state.

Since the regulating ratchet 18 can be provided in a dead space not overlapping with the rotating shaft of the driving pulley 11, a compact structure can be realized. Since the regulating ratchet 18 is attached to the engine-side driving pulley 11, a deflection of the rotation can be minimized and the rotation can be stabilized.

The pressing unit 40 can be formed compactly by the regulating cam 41 and the leaf spring 42.

[Second Embodiment]

Figure 4A:
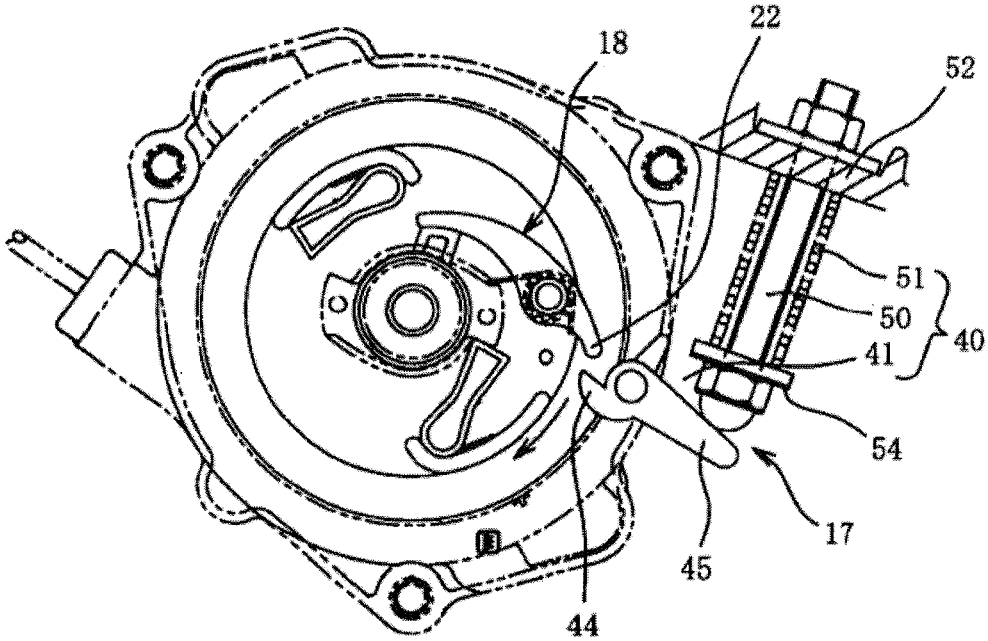
FIGS. 4A and 4B are respectively a side view immediately before the rotation of a driving pulley is regulated and a side view immediately before a regulation is released in an engine starter of a second embodiment.
Figure 4B:
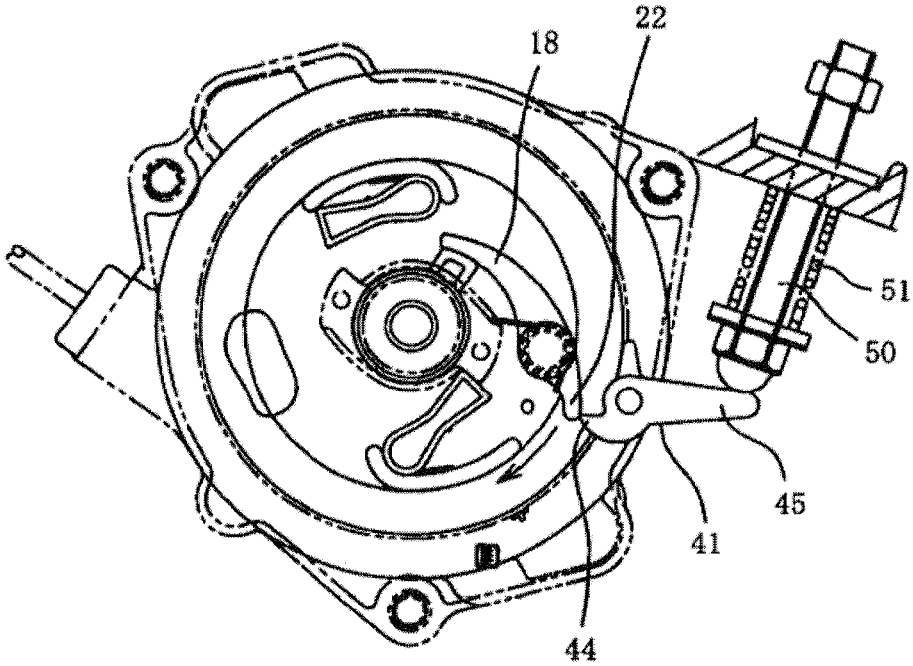

FIGS. 4A and 4B show a starter of a second embodiment with a pressing unit having another structure. A pressing unit 40 includes a shaft member 50 and a coil spring 51, in addition to the above-described regulating cam 41.

The regulating cam 41 is substantially the same as that of the first embodiment.

A support part 52 is formed in a starter case 1, and the shaft member 50 is provided to pass through the support member 52 to be slidable. The shaft member 50 is urged by a torsion coil spring (not shown in the drawing) so that a distal end of the shaft member 50 is engaged with an engaging piece 45 of the regulating cam 41.

The coil spring 51 is provided on an outer periphery of the shaft member 50. One end of the coil spring 51 is engaged with the support part 52 of the starter case 1, and the other end is engaged with a spring receiver 54 provided at the distal end side of the shaft member 50. Thus, the coil spring 51 constantly urges the shaft member 50 to press the engaging piece 45 of the regulating cam 41 so that a pressing piece 44 is engaged with an engaging pawl 22 of a regulating ratchet 18 within the starter case 1.

As in the above-described leaf spring 42, a resilient pressing force by the spring load of the coil spring 51 is set to a level the same as the starting rotational torque (rotational torque necessary for starting an engine) or higher According to the above-described structure, as in the first embodiment, normally, the resilient pressing force of the coil spring 51 is applied to the regulating cam 41, and the engaging pawl 22 of the regulating ratchet 18 is engaged with the pressing piece 44 of the regulating cam 41. Therefore, even when a starter rope 6 is pulled and a barrel 4 is rotated, a cam plate 5 cannot be rotated, as shown in FIGS. 4A and 4B (see also FIG. 1). When an accumulated rotational torque does not satisfy the spring load (resilient pressing force) of the coil spring 51 exceeding the starting rotational torque, the cam plate 5 is not rotated. As a torque-accumulation spiral spring 10 is wound-up, the accumulated rotational torque is increased. And, when the accumulated rotational torque exceeds the resilient pressing force of the coil spring 51, the cam plate 5 is rotated little by little. Accordingly, the pressing piece 44 of the regulating cam 41 is pushed by the engaging pawl 22 of the regulating ratchet 18 and moved backward (see FIG. 4B). Finally, the engaging pawl 22 is disengaged from the pressing piece 44 so that the accumulated rotational torque is abruptly released. As a result, the rotational torque of the torque-accumulation spiral spring 10 is transmitted to the cam plate 5, and further transmitted to a driving pulley 11 through a clutch mechanism to thereby rotate the driving pulley 11 and start the engine.

When the engine is rotated, the engaging pawl 22 of the regulating ratchet 18 is not engaged with the pressing piece 44 of the regulating cam 41, and when the rotation of the engine is stopped, the engaging pawl 22 returns to a position where the engaging pawl 22 can be engaged with the pressing piece 44 of the regulating cam 41, as in the first embodiment.

[Third Embodiment]

Figure 5B:
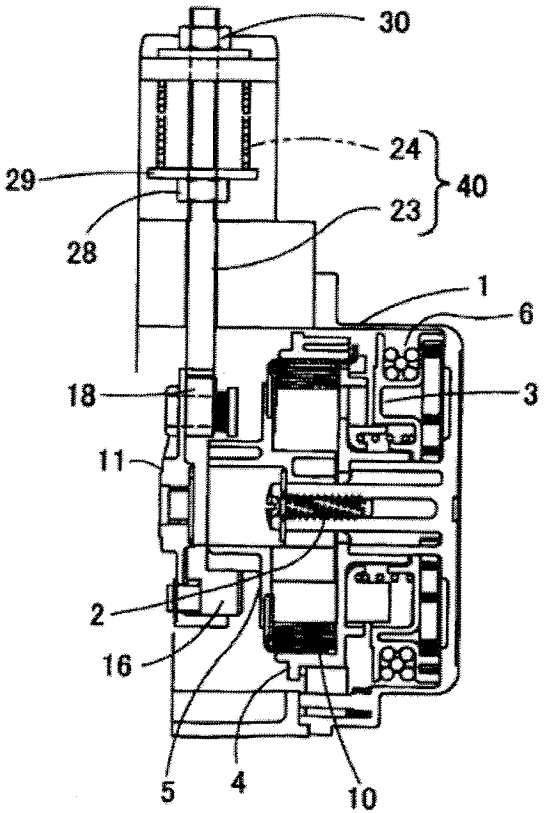
FIGS. 5A and 5B are respectively a side view and a longitudinally sectional view of an engine starter of a third embodiment.
Figure 5A:
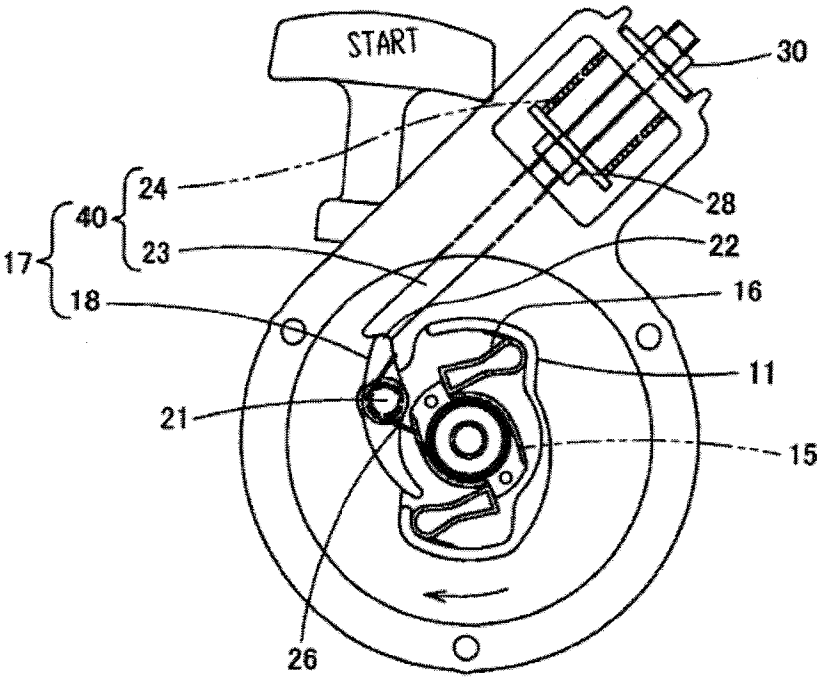

FIGS. 5A and 5B show a starter of a third embodiment with a pressing unit having still another structure. A rotation regulating mechanism 17 includes a regulating ratchet 18 provided on a driving pulley 11 and a pressing unit 40 for regulating an operation range of the regulating ratchet 18 by a given resilient pressing force.

In the drawings, the same reference numerals as those of the above-described embodiments designate the same members.

The regulating ratchet 18 is pivotably provided on a support shaft 21 provided in the engine-side driving pulley 11. A torsion coil spring 26 constantly urges an engaging pawl 22 to protrude outside.

The pressing unit 40 includes a stopper shaft 23 and a coil spring 24. The stopper shaft 23 passes through a starter case 1 to be slidable, and is urged by the coil spring 24 so that a distal end of the stopper shaft 23 is engaged with the engaging pawl 22 of the regulating ratchet 18.

The above-described coil spring 24 is visually recognizable from exterior. As an adjusting unit for adjusting a resilient force of the coil spring 24, a load adjusting nut 28 is attached to a male screw part of the stopper shaft 23. A position of a spring receiving plate 29 is adjusted by the load adjusting nut 28 to thereby adjust a spring load. Also, a stroke adjusting nut 30 is provided to adjust a stroke of the stopper shaft 23.

Also in the above-described rotation regulating mechanism 17, when a starter rope 6 is pulled to rotate a barrel 4 and a rotational torque accumulated in a torque-accumulation spiral spring 10 does not satisfy the spring load (resilient pressing force) of the coil spring 24 exceeding the starting rotational torque, the regulating ratchet 18 is held in a state that the regulating ratchet 18 is engaged with the stopper shaft to regulate the rotation of the driving pulley 11. Accordingly, a cam plate 5 is not rotated. As the torque-accumulation spiral spring 10 is wound-up, the accumulated rotational torque is increased. And, when the accumulated rotational torque exceeds the spring load of the coil spring 24 of the stopper shaft 23, the rotational torque is transmitted to the driving pulley 11 and the regulating ratchet 18 pushes back the stopper shaft 23. Finally, when the regulating ratchet 18 is disengaged from the stopper shaft 23, the rotational torque accumulated in the torque-accumulation spiral spring 10 is abruptly released. As a result, the accumulated rotational torque is transmitted to the cam plate 5, and further transmitted to the driving pulley 11 through a clutch mechanism including a centrifugal ratchet 16 and a cam pawl 15. Since the driving pulley 11 is rotated with the large rotational torque sufficiently for starting the engine, the engine is surely rotated. After the torque-accumulation spiral spring 10 is released and the cam plate 5 is rotated, the engaging pawl 22 of the regulating ratchet 18 is retracted inside due to a centrifugal force. Thus, the engaging pawl 22 is not engaged with the stopper shaft 23.

After the stopper shaft 23 is disengaged from the regulating ratchet 18, the stopper shaft 23 returns to a stand-by position. Thus, when the rotation of the cam plate 5 is stopped after the engine is started and the engaging pawl 22 is urged again to protrude outside by the torsion coil spring 26, the stopper shaft 23 is engaged with the regulating ratchet 18 to return again to a stand-by state.

[Fourth Embodiment]

Figure 6B:
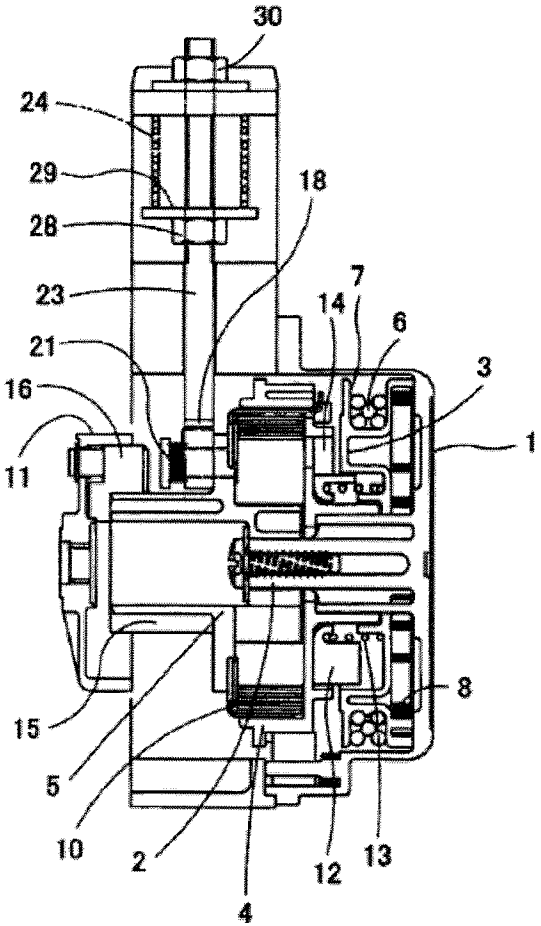
FIGS. 6A and 6B are respectively a side view and a longitudinally sectional view of an engine starter of a fourth embodiment.
Figure 6A:
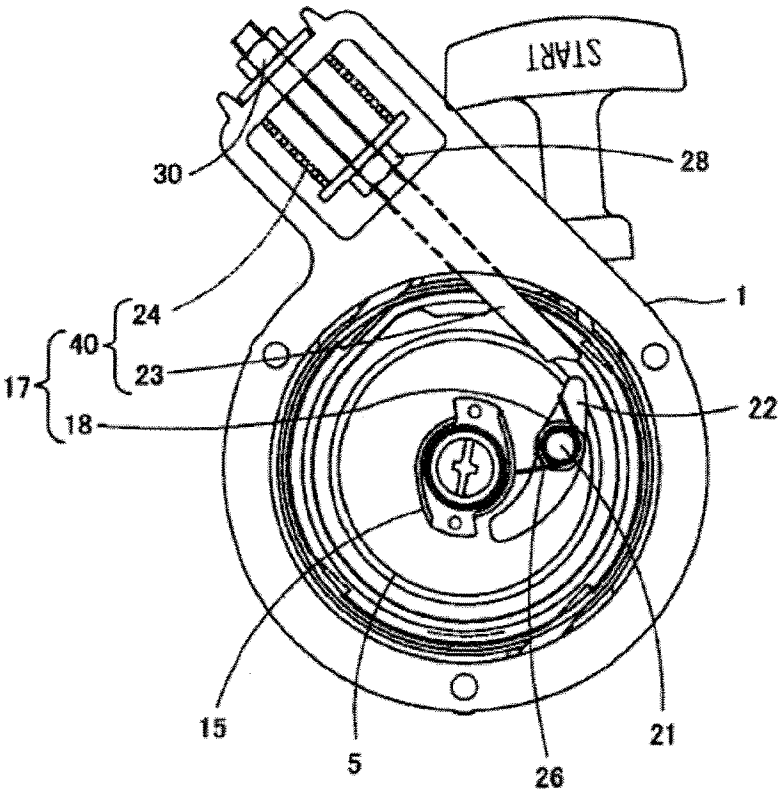

FIGS. 6A and 6B show a starter of a fourth embodiment with a pressing unit having still another structure. A rotation regulating mechanism 17 includes a regulating ratchet 18 provided on a cam plate 5 and a pressing unit 40 provided in a starter case 1 to regulate an operation range of the regulating ratchet 18.

In the drawings, the same reference numerals as those of the above-described embodiments designate the same members.

A support shaft 21 is provided on a cam plate 5 at a position shifted outward as compared with a cam pawl 15, and the regulating ratchet 18 is pivotably provided on the support shaft 21. A torsion coil spring 26 urges the regulating ratchet 18 so that an engaging pawl 22 at one end thereof is protruded outside.

The pressing unit 40 includes a stopper shaft 23 to be engaged with the regulating ratchet 18 and a coil spring (urging unit) 24 to provide a resilient force onto the stopper shaft 23. By the resilient force from the coil spring 24, the stopper shaft 23 is engaged with the regulating ratchet 18 against the resilient force of a torque-accumulation spiral spring 10 until a rotational torque necessary for starting an engine is accumulated. The spring load of the coil spring 24 is set to a level the same as the starting rotational torque (rotational torque necessary for starting the engine) or higher.

The stopper shaft 23 passes through the starter case 1 to be slidable, and is urged by the torsion coil spring 26 so that a distal end of the stopper shaft 23 is engaged with the engaging pawl 22 of the regulating ratchet 18.

The coil spring 24 constantly urges the stopper shaft 23 to protrude toward the cam plate 5 so as to be engaged with the engaging pawl 22 at the one end of the regulating ratchet 18.

The above-described coil spring 24 is visually recognizable from exterior. As an adjusting unit for adjusting a resilient force of the coil spring 24, a load adjusting nut 28 is attached to a male screw part of the stopper shaft 23. A position of a spring receiving plate 29 is adjusted by the load adjusting nut 28 to thereby adjust the spring load. Also, a stroke adjusting nut 30 is provided to adjust a stroke of the stopper shaft 23.

In order to allow the user to visually recognize a bending state of the coil spring 24, the coil spring 24 may be directly exposed, or a meter or the like indicating the bending state may be provided.

An operation of the above-described rotation regulating mechanism 17 will be described below.

Figure 7:
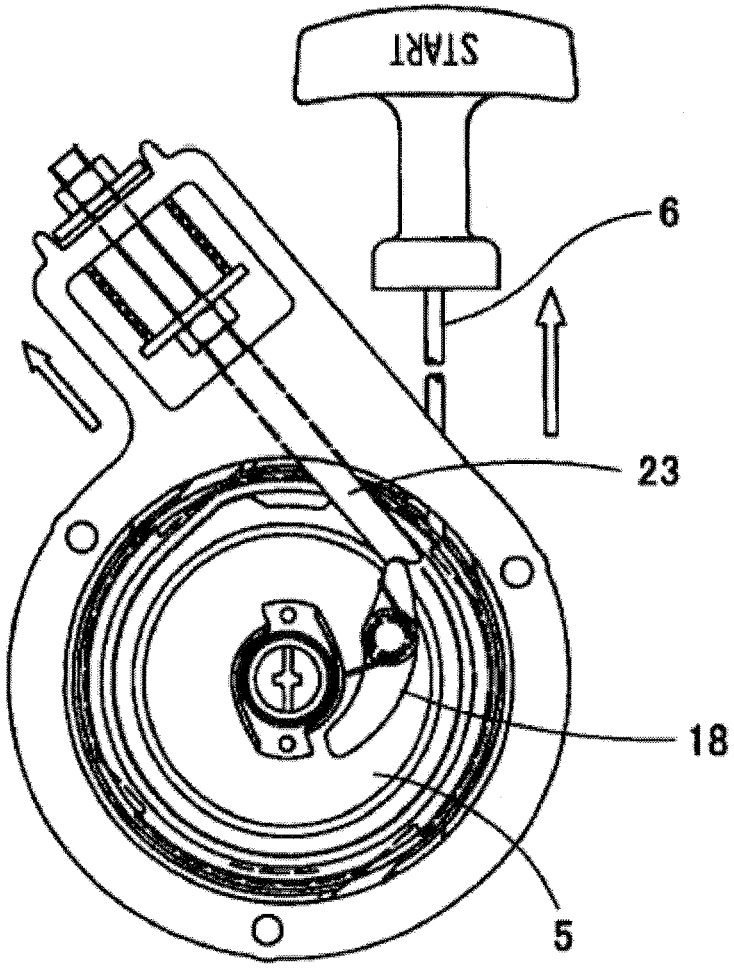
FIG. 7 illustrates a state at an initial time of rotation of a cam plate.
Figure 8:
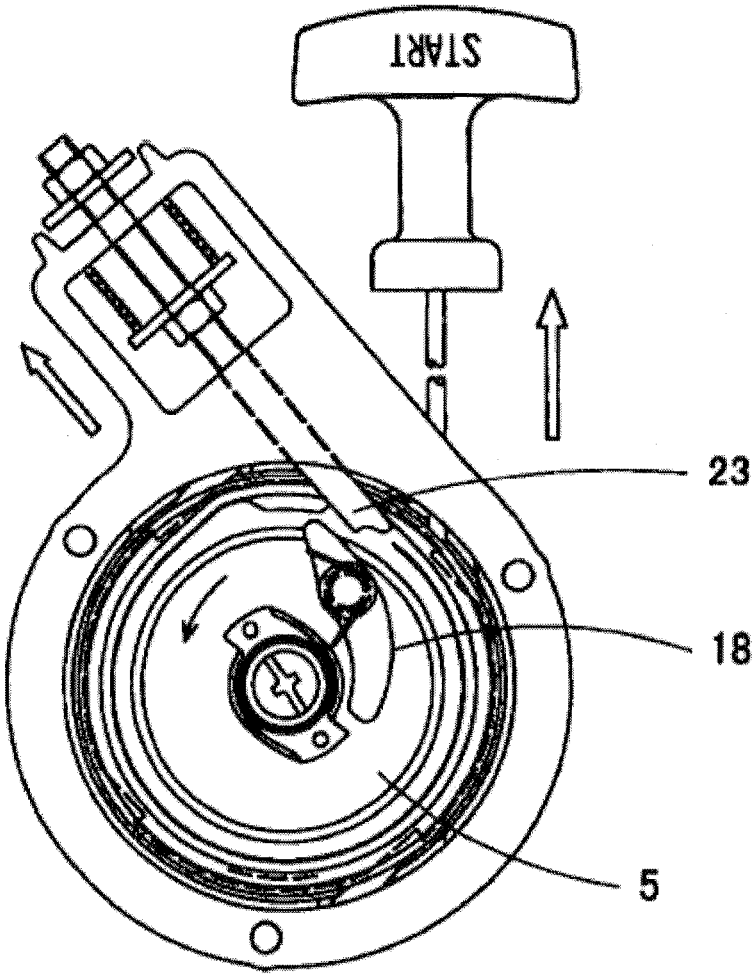
FIG. 8 illustrates a state that an engagement of the cam plate with a regulating ratchet is released.
Figure 9:
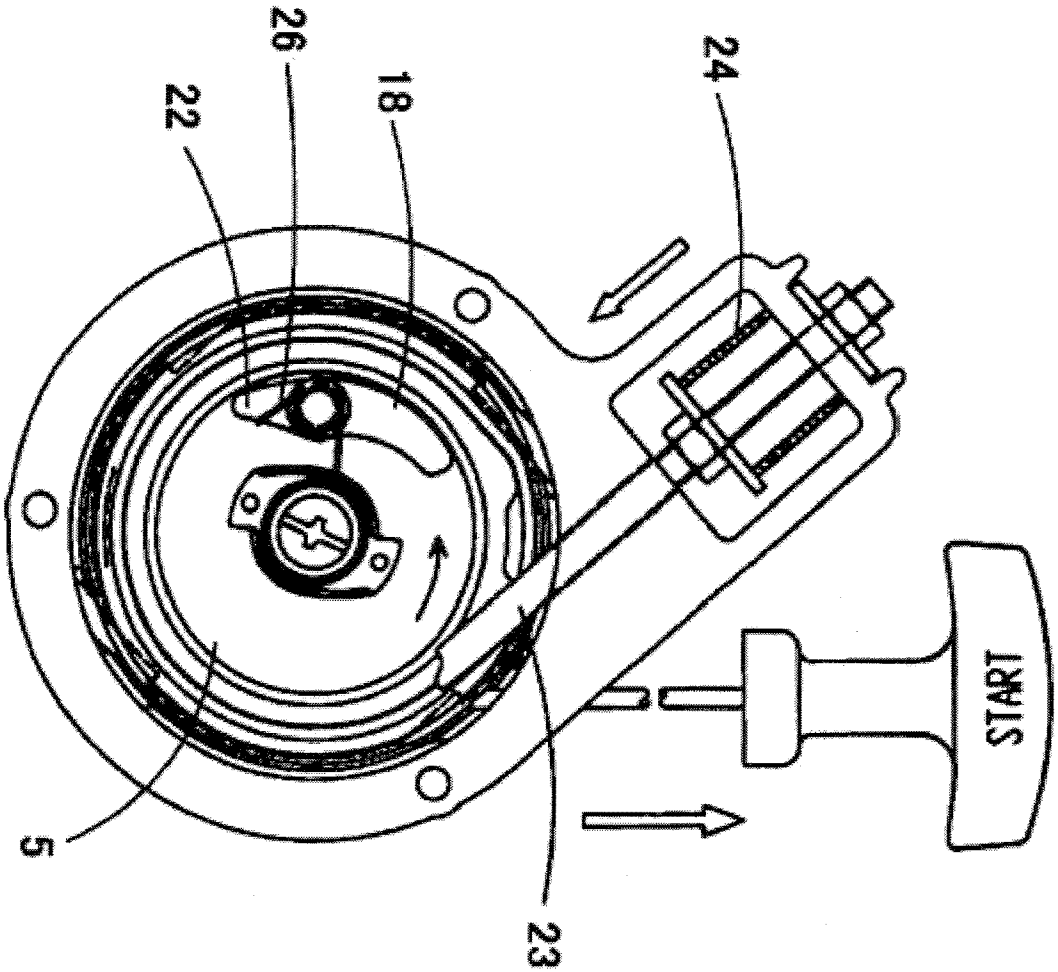
FIG. 9 illustrates a state that the cam plate is rotated.

When a starter rope 6 is pulled to rotate a barrel 4 and the rotational torque accumulated in a torque-accumulation spiral spring 10 does not satisfy the spring load of the coil spring 24 exceeding the starting rotational torque, the regulating ratchet 18 is held to be engaged with the stopper shaft 23 as shown in FIG. 7, and the cam plate 5 is not rotated. As the torque-accumulation spiral spring 10 is wound-up, the accumulated rotational torque is increased. And, when the accumulated rotational torque exceeds the spring load of the coil spring 24, the regulating ratchet 18 pushes back the stopper shaft 23, and the regulating ratchet 18 is disengaged from the stopper shaft 23, as shown in FIG. 8. Thus, the rotational torque accumulated in the torque-accumulation spiral spring 10 is abruptly released. As a result, as shown in FIG. 9, the accumulated rotational torque is transmitted to the cam plate 5, and further transmitted to a driving pulley 11 through a clutch mechanism including a centrifugal ratchet 16 and the cam pawl 15. Since the driving pulley 11 is rotated with the large rotational torque sufficiently for starting the engine, the engine is surely rotated. After the torque-accumulation spiral spring 10 is released and the cam plate 5 is rotated, the engaging pawl 22 of the regulating ratchet 18 is retracted inside due to a centrifugal force. Thus, the engaging pawl 22 is not engaged with the stopper shaft 23.

After the stopper shaft 23 is disengaged from the regulating ratchet 18, as shown in FIG. 9, the stopper shaft 23 returns to a stand-by position by the coil spring 24. Thus, when the rotation of the cam plate 5 is stopped after the engine is started and the engaging pawl 22 is urged again to protrude outside by the torsion coil spring 26, the stopper shaft 23 is engaged with the regulating ratchet 18 to return again to a stand-by state.

To adjust the rotational torque to be accumulated in the torque-accumulation spiral spring 10, for example, depending on the rotational resistance of the engine, the load adjusting nut 28 may be adjusted. And, to adjust the stroke of the stopper shaft 23, the stroke adjusting nut 30 may be adjusted.

Figure 10:
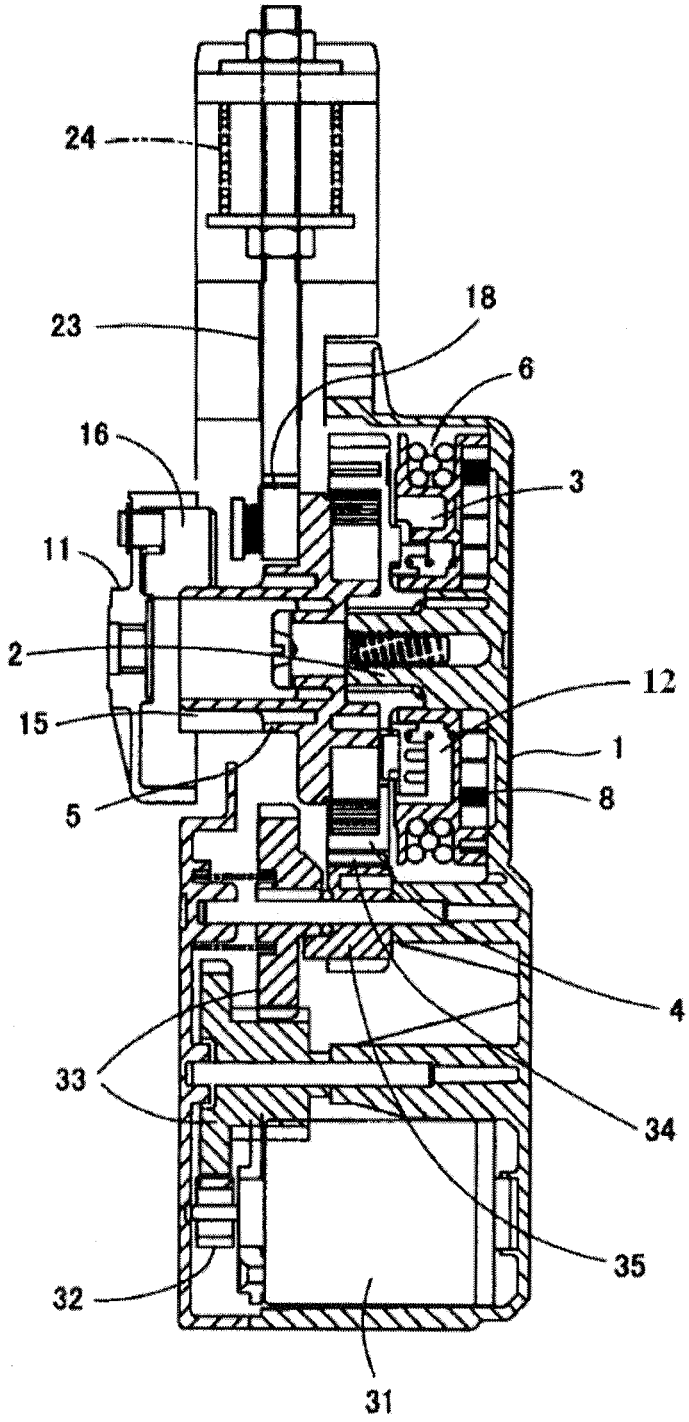
FIG. 10 is a longitudinally sectional view of the engine starter having a sel-motor.

FIG. 10 shows a starter provided with a sel-motor 31 as well as a starter rope 6 and a rope reel 3. An output gear 32 of the sel-motor 31 meshes with a gear 34 formed on an outer periphery of a barrel 4, through a reduction gear 33 and a transmission gear 35. The reduction gear 33 and the transmission gear 35 are engaged with each other only when they are rotated in one direction. When the sel-motor (self-starting-motor) 31 is operated, a rotational torque is transmitted to the barrel 4 from the reduction gear 33 to rotate the barrel 4. At this time, the rope reel 3 is rotated relatively in an opposite direction, and a one-way clutch 12 is disconnected and only the barrel 4 is rotated. Since a subsequent transmission of the rotation is the same as that described above, the same reference numerals are employed and an explanation is omitted.

According to the above structure, when the rotational torque necessary for starting the engine is not accumulated in the cam plate 5, the stopper shaft 23 (pressing unit 40) is engaged with the regulating ratchet 18. When the rotational torque necessary for starting the engine is accumulated in the torque-accumulation spiral spring 10, the regulating ratchet 18 is operated by the accumulated rotational torque to be disengaged from the stopper shaft 23, and rotate the cam plate 5. Accordingly, a sufficient rotational torque (energy) is accumulated in the torque-accumulation spiral spring 10 irrespective of the variation in the rotational resistance of the engine so that the engine can be surely started.

Further, the stopper shaft 23 of the pressing unit 40 is held to be engaged with the regulating ratchet 18 against the resilient force of the torque-accumulation spiral spring 10 until the rotational torque necessary for starting the engine is accumulated in the torque-accumulation spiral spring 10. After the stopper shaft 23 is moved to a position where the stopper shaft is disengaged from the regulating ratchet 18, the stopper shaft 23 is moved to return to a stand-by position by the coil spring 24. Thus, after the engine is started, the stopper shaft 23 does not need to be externally operated to return to the stand-by position.

When the bending state of the coil spring 24 is visually recognizable from exterior, for example, a pulling amount of the starter rope 6 further required to start the engine can be checked.

In the embodiments shown in FIGS. 1 to 9, the sel-motor may be used.

In the above-described embodiments, the clutch mechanism between the cam plate 5 and the driving pulley 11 includes the centrifugal ratchet 16 and the cam pawl 15, however, the clutch mechanism is not limited thereto. For example, a friction type clutch mechanism may be used.

Further, in the above-described embodiment, as a unit for accumulating the rotational torque energy, a coil spring may be used in place of the torque-accumulation spiral spring.

The invention claimed is:

1. A starter comprising:

a starter case;

a rotational torque applying unit provided in the starter case and configured to generate a rotational torque;

a torque-accumulation spring configured to accumulate the rotational torque applied from the rotational torque applying unit;

a rotating member provided in the starter case and configured to receive the rotational torque from the torque-accumulation spring;

a driving pulley connected to an engine and configured to be engaged/disengaged with the rotating member by a centrifugal ratchet; and a rotation regulating mechanism including:

a regulating ratchet provided on the driving pulley or the rotating member at a position shifted from a rotation center thereof; and a pressing unit provided on the starter case and urged by a given resilient pressing force to be engaged with the regulating ratchet, wherein, when the rotational torque accumulated in the torque-accumulation spring exceeds the given resilient pressing force, the driving pulley or the rotating member urges back the pressing unit via the regulating ratchet so that the regulating ratchet is disengaged from the pressing unit, to thereby release the rotational torque, wherein, when the driving pulley or the rotating member is rotated, the regulating ratchet is held in a position where the regulating ratchet is not engaged with the pressing unit due to a centrifugal force, and wherein, when the driving pulley or the rotating member is stopped, the regulating ratchet is biased to return to a position where the regulating ratchet is engaged with the pressing unit.

2. The starter of claim 1, wherein the resilient pressing force provided to the pressing unit is set to be larger than a starting rotational torque necessary to start the engine.

3. The starter of claim 1, wherein the centrifugal ratchet connecting the rotating member and the driving pulley comprises a clutch mechanism.

4. The starter of claim 1, wherein the pressing unit includes:

a regulating cam pivotably provided in the starter case and having an end to be engaged with the regulating ratchet; and a resilient unit configured to provide the resilient pressing force to the regulating cam.

5. The starter of claim 1, wherein the pressing unit includes:

a shaft slidably provided in the starter case and having an end to be engaged with the regulating ratchet; and a resilient unit configured to provide the resilient pressing force to the shaft.

6. The starter of claim 1, wherein the pressing unit includes:

a regulating cam pivotably provided in the starter case and having an end to be engaged with the regulating ratchet;

a shaft provided engaged with the regulating cam; and a resilient unit configured to provide the resilient pressing force to the shaft.

7. The starter of claim 4, wherein the resilient unit is a leaf spring or a coil spring.

8. The starter of claim 5, wherein the resilient unit is a leaf spring or a coil spring.

9. The starter of claim 6, wherein the resilient unit is a leaf spring or a coil spring.

10. The starter of claim 1, wherein the torque-accumulation spring is a spiral spring or a coil spring.

11. A starter comprising:

a starter case;

a rotational torque applying unit provided in the starter case and configured to generate a rotational torque;

a torque-accumulation spring cooperable with the rotational torque applying unit, the torque-accumulation spring accumulating the rotational torque applied from the rotational torque applying unit;

a rotating member provided in the starter case and cooperable with the torque-accumulation spring;

a driving pulley connectable to an engine and selectively engageable with the rotating member by a centrifugal ratchet; and a rotation regulating mechanism including:

a regulating ratchet provided on the driving pulley or the rotating member at a position shifted from a rotation center thereof, and a pressing unit provided on the starter case and urged into engagement with the regulating ratchet, wherein the regulating ratchet is displaced against a force of the pressing unit according to the rotational torque accumulated in the torque-accumulation spring, wherein, when the driving pulley or the rotating member is rotated, the regulating ratchet is held in a position where the regulating ratchet is not engaged with the pressing unit due to a centrifugal force, and wherein, when the driving pulley or the rotating member is stopped, the regulating ratchet is biased to return to a position where the regulating ratchet is engaged with the pressing unit.

* * * * *